US006538602B2

(12) United States Patent
Natsume et al.

(10) Patent No.: US 6,538,602 B2
(45) Date of Patent: Mar. 25, 2003

(54) SATELLITE-TRACKING ANTENNA CONTROLLING APPARATUS

(75) Inventors: Koichi Natsume, Tokyo (JP); Tomoaki Fukushima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/054,948

(22) Filed: Jan. 25, 2002

(65) Prior Publication Data

US 2003/0016172 A1 Jan. 23, 2003

(30) Foreign Application Priority Data

Jul. 23, 2001 (JP) ..... 2001-220966

(51) Int. Cl.[7] ..... H01Q 3/00
(52) U.S. Cl. ..... 342/359
(58) Field of Search ..... 342/75, 76, 357.15, 342/359, 426, 427; 343/757, 758

(56) References Cited

U.S. PATENT DOCUMENTS 5,073,783 A * 12/1991 Uematsu et al. ..... 342/359
5,223,845 A * 6/1993 Eguchi ..... 342/359
6,075,482 A * 6/2000 Fukushima ..... 342/359

FOREIGN PATENT DOCUMENTS

| | | |
|---|---|---|
| JP | 4-208722 | 7/1992 |
| JP | 5-102895 | 4/1993 |
| JP | 8-271561 | 10/1996 |

* cited by examiner

*Primary Examiner*—Dao Phan
(74) *Attorney, Agent, or Firm*—Oblon, Spivak, McClelland, Maier & Neustadt, P.C.

(57) ABSTRACT

An axial-discrepancy amount calculating section 21 calculates discrepancy amounts between an azimuth angle and an elevation angle of a satellite 9 in the mobile object-fixed coordinate system computed by a satellite direction computing section 19 and an azimuth angle and an elevation angle of an antenna in the gimbal coordinate system detected after the antenna is directed by a peak direction drive controlling section 12 to a direction in which a peak received signal is given, and then commands an axial-discrepancy amount correcting section 20 to change the axial discrepancy amount.

4 Claims, 7 Drawing Sheets

SATELLITE-TRACKING ANTENNA CONTROLLING APPARATUS

BACKGROUND OF THE INVENTION

1. Field of the Invention

The present invention relates to a satellite-tracking antenna controlling apparatus and, more particularly, to a satellite-tracking antenna controlling apparatus installed in a mobile object such as a vehicle, a ship, an airplane, and the like, which communication with a communication satellite.

2. Description of the Related Art

FIG. 9 is a block diagram showing an antenna apparatus according to the related art shown in JP-A-Hei.8-271561, for example. In FIG. 9, reference numeral 1 denotes an antenna for receiving transmitted wave from another antenna arranged to oppose, reference numeral 2 denotes an antenna driving section for changing a directional direction of the antenna 1, reference numeral 3 denotes a transmitting section for transmitting radio wave used to measure the electric field strength, reference numeral 4 denotes a receiving section for receiving a received signal to measure the electric field strength, reference numeral 5 denotes an electric field strength measuring section for measuring the electric field strength, reference numeral 6 denotes a data recording section for recording the measured electric field strength and the measuring time, reference numeral 7 denotes a time matching section for matching the times in a change of the directional direction of the antenna 1, the measurement of the electric field strength, and the data recording, and reference numeral 8 denotes an alignment controlling section for controlling the antenna driving section 2, the transmitting section 3, the electric field strength measuring section 5, the data recording section 6, and the time matching section 7.

When the mobile communication is carried out between two points by using antennas each having the directivity, it is necessary to mutually identify positions of the destination communication devices and to search a direction having the highest received electric field strength to fix the antennas. For this reason, the antenna apparatus according to the related art shown in FIG. 9 receives the transmitted wave transmitted from the destination side via the antenna 1 at a time set previously by the time matching section, and scans the antenna 1 by the antenna driving section 2 at a time of this reception. The received electric field strength is measured by the electric field strength measuring section 5 while the antenna 1 scans and the received electric field strength, the time, and the directional direction of the antenna are recorded by the data recording section 6, and thus the direction of the destination side communication device can be decided based on the resultant data.

Since the antenna apparatus according to the related art is constructed as described above, the alignment of mutual antenna directional directions of the antenna apparatus arranged at two points can be adjusted. However, in the antenna apparatus that executes the communication while changing the relative positional relationship between the mobile object and the communication satellite, in order to direct the antenna to the destination side antenna, in some cases open-loop drive control that drives the antenna based on information of the position and attitude information of the gyro or the like provided to the mobile object and feedback drive control that drives the antenna based on received level are employed in combination. If axial discrepancy is present between a reference axis of a measuring device such as the gyro or the like (normally the gyro or the like is fixed to the mobile object, thus referred to as "an axis of a mobile object-fixed coordinate system" hereinafter in this meaning) and an antenna drive axis (referred to as "an axis of a gimbal coordinate system" hereinafter), there is a problem that since an error of the directional direction due to the axial discrepancy is generated in the open-loop drive control, the tracking control cannot carried out with high precision. Also, in the antenna apparatus that is installed in an airplane or the like to execute the communication with the satellite, there is a problem that even if an amount of the axial discrepancy between the axis of the mobile object-fixed coordinate system and the axis of the gimbal coordinate system has already been known on a runway of an airport, for example, the amount of the axial discrepancy between the axis of the mobile object-fixed coordinate system and the axis of the gimbal coordinate system are changed much more due to environmental changes such as atmospheric pressure, atmospheric temperature, and the like after takeoff.

SUMMARY OF THE INVENTION

The present invention has been made to overcome the above problems and it is an object of the present invention to provide a satellite-tracking antenna controlling apparatus capable of executing satellite-tracking control of an antenna with high precision by calculating an axial discrepancy amount between the mobile object-fixed coordinate system and the gimbal coordinate system of the antenna in case of executing the communication between the mobile object and the communication satellite, and also the satellite-tracking antenna controlling apparatus increasing the maintainability of the axial discrepancy amount.

A satellite-tracking antenna controlling apparatus according to a first aspect of the present invention comprises a satellite direction computing section for computing an azimuth angle and an elevation angle of a satellite in a mobile object-fixed coordinate system fixed to a mobile object based on position information and attitude information of the mobile object, that are output from an inertial navigation unit provided to the mobile object and position information of the satellite as a tracking object, an axial-discrepancy amount correcting section for correcting the azimuth angle and the elevation angle of the satellite computed in the satellite direction computing direction based on an axial discrepancy amount between the mobile object-fixed coordinate system and a gimbal coordinate system of the antenna that is installed in the mobile object to output the corrected azimuth angle and the corrected elevation angle as a drive command signal, a receiver for receiving a signal transmitted from the satellite via the antenna that is driven by the drive command signal, a peak direction drive controlling section for driving the antenna toward a direction in which a level of a received signal received by the receiver becomes peak, an angle sensor for detecting an azimuth angle and an elevation angle of the antenna driven by the peak direction drive controlling section in the gimbal coordinate system, and an axial-discrepancy amount calculating section for computing discrepancy amounts between the azimuth angle and the elevation angle of the antenna in the gimbal coordinate system detected by the angle sensor and the azimuth angle and the elevation angle of the satellite computed by the satellite direction computing section to command the axial-discrepancy amount correcting section to change the axial discrepancy amount.

According to a second aspect of the invention, there is provided the satellite-tracking antenna controlling apparatus according to the first aspect of the invention, wherein the axial-discrepancy amount calculating section commands the axial-discrepancy amount correcting section to change the axial discrepancy amount when the axial-discrepancy amount calculating section decides that the mobile object is going straight on based on the attitude information of the mobile object output from the inertial navigation unit.

According to a third aspect of the invention, there is provided the satellite-tracking antenna controlling apparatus according to the first aspect of the invention, wherein the axial-discrepancy amount calculating section commands the axial-discrepancy amount correcting section to change the axial discrepancy amount when the axial-discrepancy amount calculating section decides that the mobile object has reached a predetermined altitude based on altitude information of the mobile object output from the inertial navigation unit.

According to a fourth aspect of the invention, there is provided the satellite-tracking antenna controlling apparatus according to the first aspect of the invention, wherein the axial-discrepancy amount calculating section commands the axial-discrepancy amount correcting section to change the axial discrepancy amount when the axial-discrepancy amount calculating section decides that a predetermined time has lapsed from a start time of the mobile object.

DETAILED DESCRIPTION OF THE PREFERRED EMBODIMENTS

Embodiment 1

Figure 1:
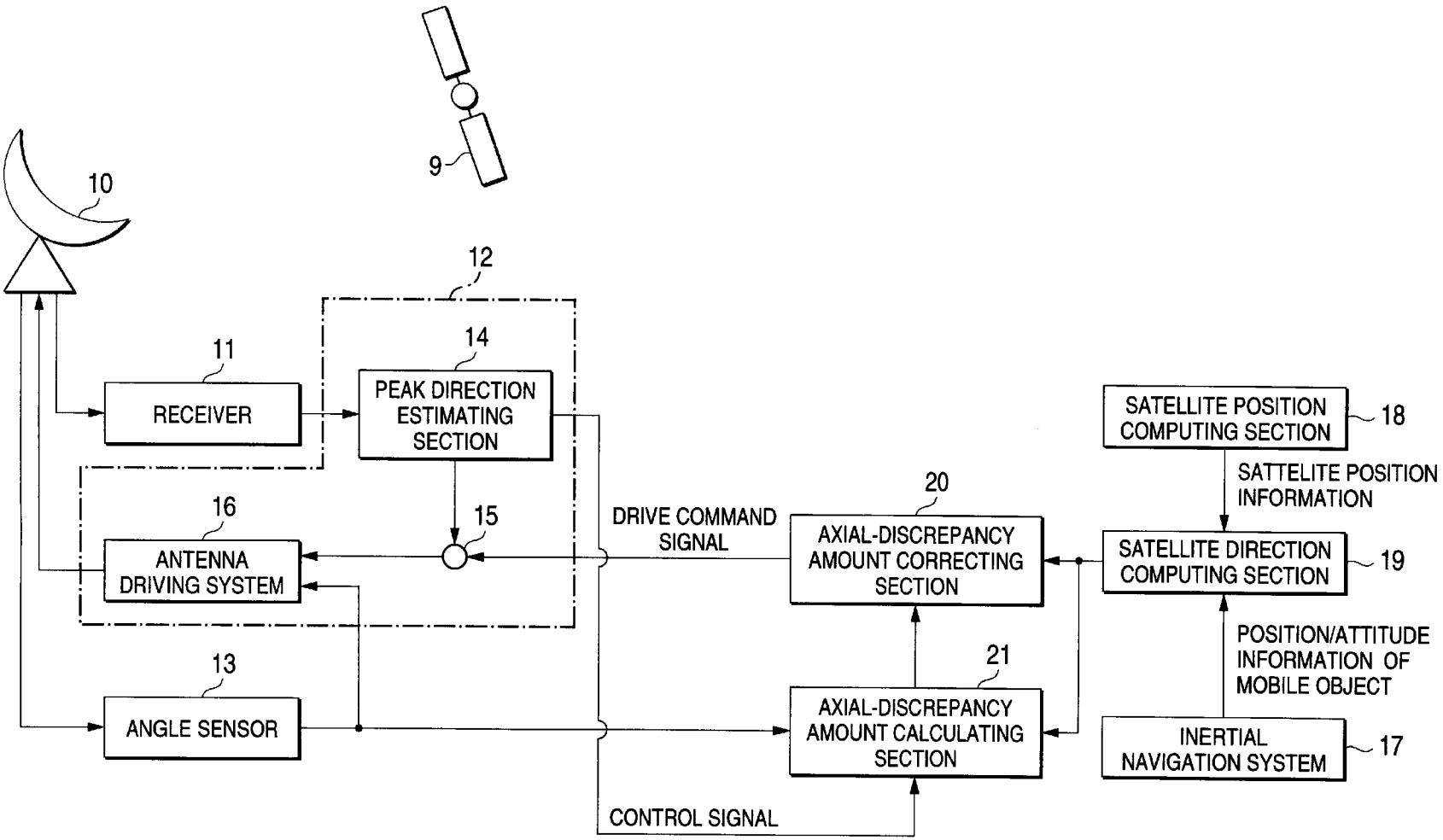
FIG. 1 is a block diagram showing a configuration of a satellite-tracking antenna controlling apparatus according to an embodiment 1 of the present invention.

A satellite-tracking antenna controlling apparatus according to an embodiment 1 of the present invention will be explained with reference to FIG. 1 hereunder. FIG. 1 is a block diagram showing a configuration of the satellite-tracking antenna controlling apparatus according to the embodiment 1 of the present invention. In FIG. 1, reference numeral 9 denotes a satellite as a tracking object, and reference numeral 10 denotes an antenna used to communicate with the satellite 9 via the radio. Reference numeral 11 denotes a receiver for receiving a signal transmitted from the satellite 9 via the antenna 10, reference numeral 12 denotes a peak direction drive controlling section for driving the antenna 10 to a direction at which a level of the received signal received by the receiver 11 becomes peak and reference numeral 13 denotes an angle sensor for sensing an azimuth angle and an elevation angle in the gimbal coordinate system of the antenna 10. In the peak direction drive controlling section 12, reference numeral 14 denotes a peak direction estimating section for estimating the direction of the antenna 10, at which the received signal becomes peak, based on the power level of the received signal received from the receiver 11 to output a drive amount toward the peak direction, reference numeral 15 denotes an adder for adding a drive command signal described later and the drive amount output from the peak direction estimating section 14 to output the resultant signal as the drive command signal after the peak direction estimation and reference numeral 16 denotes an antenna driving unit for driving the antenna 10 to the angle commanded by the drive command signal based on the drive command signal output from the adder 15 and the azimuth angle and the elevation angle of the antenna 10 output from the angle sensor 13. Reference numeral 17 denotes an inertial navigation unit for detecting position information and attitude information of the mobile object, reference numeral 18 denotes a satellite position computing section for computing the position of the satellite 9 based on an orbit information, and reference numeral 19 denotes a satellite direction computing section for computing the azimuth angle and the elevation angle of the satellite 9 in the mobile object-fixed coordinate system based on the position information and the attitude information of the mobile object output from the inertial navigation unit 17 and the position information of the satellite 9 output from the satellite position computing section 18. Reference numeral 20 denotes an axial-discrepancy amount correcting section for correcting the azimuth angle and the elevation angle of the satellite 9 computed by the satellite direction computing section 19 based on the axial discrepancy amount between the mobile object-fixed coordinate system and the gimbal coordinate system of the antenna 10 to output the corrected angles as the drive command signal, and reference numeral 21 denotes an axial-discrepancy amount calculating section for computing discrepancy amounts between the azimuth angle and the elevation angle of the antenna 10 output from the angle sensor 13 in the gimbal coordinate system and the azimuth angle and the elevation angle of the satellite 9 computed by the satellite direction computing section 19 to command the axial-discrepancy amount correcting section 20 to change the axial discrepancy amount.

Then, an operation of the satellite-tracking antenna controlling apparatus according to the embodiment 1 will be explained hereunder. First, in order to direct the antenna 10 installed in the mobile object toward the direction of the satellite 9, it is necessary to decide the direction of the satellite 9. The satellite position computing section 18 computes the position of the satellite, which is represented by the latitude, the longitude, the altitude, and the like of the satellite 9, for example, by using the orbit information of the tracking objective satellite stored in the apparatus, and outputs it. On the other hand, three-axes gyro for sensing the attitude of the mobile object, three-axes accelerometer for sensing the acceleration of the mobile object, a magnetic heading sensor for sensing the azimuth of the mobile object in relation to the geomagnetic axis, an altimeter for computing the altitude of the mobile object by using the pressure difference and the like, GPS for sensing the position of the mobile object, and the like are installed in the inertial navigation unit 17. The position of the mobile object represented by, for example, the latitude, the longitude, and the altitude and the attitude of the mobile object represented by, for example, the roll angle, the pitch angle, and the true bearing are computed based on detected values of these measuring equipments and then output. The inertial navigation unit employed in the present invention denotes units that are installed in not only the mobile objects such as the airplane, the ship, and the like, but also other mobile objects such as the vehicle, the airship, and the like. Also, in addition to the normal inertial navigation units employed in the navigation of the mobile object, all measuring equipments that are installed in the mobile object to sense the position information and the attitude information of the mobile object, although not always employed in the service for the navigation, are contained in the inertial navigation unit of the present invention, that is set forth in claims and the detailed description of the invention. This is similarly true of embodiments described in the following.

The satellite direction computing section 19 computes and outputs the azimuth angle and the elevation angle of the satellite 9 in the mobile object-fixed coordinate system fixed to the mobile object, based on the satellite position information output from the satellite position computing section 18 and the position information and the attitude information of the mobile object output from the inertial navigation unit 17. Also, a unit vector in the satellite direction viewed from an origin of the mobile object-fixed coordinate system may be selected as the satellite direction information output from this satellite direction computing section 19.

The axial-discrepancy amount correcting section 20 corrects the azimuth angle and the elevation angle of the satellite 9 output from the satellite direction computing section 19 in the mobile object-fixed coordinate system, by converting such angles into the azimuth angle and the elevation angle of the satellite 9 in the gimbal coordinate system while using the axial discrepancy amount stored in this axial-discrepancy amount correcting section 20 between the mobile object-fixed coordinate system, that is represented by Eulerian angles such as, for example, the roll angle, the pitch angle, the yaw angle and the like and the gimbal coordinate system of the antenna 10 to output them as the drive command signal of the antenna 10. This conversion can be carried out by preparing a coordinate transformation matrix by using above Eulerian angles to compute uniquely the azimuth angle and the elevation angle of the satellite 9 in the gimbal coordinate system based on the unit vector in the satellite direction in the gimbal coordinate system. Such unit vector in the satellite direction in the gimbal coordinate system can be derived by multiplying the unit vector in the satellite direction in the mobile object-fixed coordinate system, that can be calculated uniquely from the azimuth angle and the elevation angle of the satellite 9 in the mobile object-fixed coordinate system, by the above coordinate transformation matrix.

The drive command signal output from the axial-discrepancy amount correcting section 20 is added to the drive amount toward the peak direction output from the peak direction estimating section 14 to be inputted into the antenna driving unit 16. This antenna driving unit 16 drives the antenna 10 based on the drive command signal supplied from the adder 15 and the feedback signal that is computed from the azimuth angle and the elevation angle of the antenna 10 output from the angle sensor 13 in the gimbal coordinate system. The signal transmitted from the satellite 9 is received by the receiver 11 via the antenna 10 that is driven in this manner. The receiver 11 applies smoothing process to the high frequency signal of the tracking objective satellite received at the antenna 10 to output the received level to the peak direction estimating section 14. Here, the angle sensor 13 detects the azimuth angle and the elevation angle of the antenna 10 in the gimbal coordinate system by converting rotations of the mechanical system in the azimuth angle direction and the elevation angle direction of the antenna 10 into electric signals, and then outputs them.

The peak direction estimating section 14 estimates the peak direction of the level of the received signal in the gimbal coordinate system based on the level of the received signal output from the receiver 11 and the azimuth angle and the elevation angle of the antenna 10 output from the angle sensor 13 in the gimbal coordinate system to compute a correction amount in relation to the drive command signal as a drive amount to drive the antenna 10 toward this peak direction. Then, the computed drive amount is added to the drive command signal supplied from the axial-discrepancy amount correcting section 20 by the adder 15, as described above.

Also, the peak direction estimating section 14 has a function for deciding whether or not the directional direction of the antenna 10 can be converged into the peak direction of the level of the above received signal to output the control signal indicating that the directional direction of the antenna 10 is converged to the axial-discrepancy amount calculating section 21 during deciding that the directional direction of the antenna 10 is converged.

If the control signal indicating that the directional direction of the antenna 10 is converged is being output from the peak direction estimating section 14 as mentioned above, the axial-discrepancy amount calculating section 21 in the gimbal coordinate system stores the azimuth angle and the elevation angle of the antenna 10 output from the angle sensor 13 and the azimuth angle and the elevation angle in the satellite direction in the mobile object-fixed coordinate system output from the satellite direction computing section 19 into a memory device provided in the axial-discrepancy amount calculating section 21, computes the axial discrepancy amount between the mobile object-fixed coordinate system and the gimbal coordinate system of the antenna 10 every time when the number of data reaches a predetermined value, commands the axial-discrepancy amount correcting section 20 to change the axial discrepancy amount stored therein, and executes the initialization of the above memory device and the initialization of the drive amount toward the peak direction in the peak direction estimating section 14.

In order to explain functions of the axial-discrepancy amount calculating section 21 algebraically, coordinate systems and variables described in the following are defined. Three axes of the mobile object-fixed coordinate system are defined as x,y,z axes. These x,y,z axes correspond to the roll axis, the pitch axis, and the yaw axis of the mobile object, respectively. Three axes of the gimbal coordinate system of the antenna 10 are also defined as x',y',z' axes. If the antenna 10 is fitted ideally to the mobile object, the mobile object-fixed coordinate system coincides with the gimbal coordinate system and therefore the definition of the axes coincides with that of the mobile object-fixed coordinate system.

However, normally it is difficult to fit the antenna 10 to the mobile object to coincide perfectly the coordinate systems with each other, and thus the discrepancy occurs between the axes of these coordinate systems. The Eulerian angles of the gimbal coordinate system with respect to the mobile object-fixed coordinate system are defined as $\phi=(\phi_1, (\phi_2, \phi_3)$. These Eulerian angles $\phi_1$, $\phi_2$, $\phi_3$ correspond to the roll rotation angle, the pitch rotation angle, and the yaw rotation angle, respectively. A matrix used to transform the coordinate system from the mobile object-fixed coordinate system to the gimbal coordinate system is defined as a coordinate transformation matrix $W(\phi)$. The coordinate rotation in the coordinate transformation is executed in an order of yaw rotation, pitch rotation, and roll rotation. The azimuth angle and the elevation angle of the satellite 9 in the mobile object-fixed coordinate system are defined as $\Psi=(\Psi, \theta)$. The azimuth angle is measured from the x-axis in the xy plane of the mobile object-fixed coordinate system counterclockwise when it is viewed from the positive direction of the z-axis, and the elevation angle is measured from the xy plane to direct the positive direction of the z-axis to the positive. The azimuth angle and the elevation angle of the satellite 9 in the gimbal coordinate system are defined as $\Psi'=(\Psi', \theta')$. The definitions in the gimbal coordinate system are given similarly to the mobile object-fixed coordinate system. Differences between both azimuth angles and both elevation angles are defined as $\delta\Psi=\Psi'-\Psi=(\delta\Psi, \delta\theta)=(\Psi'-\Psi, \theta'-\theta)$. In addition, the unit vector in the satellite direction in the mobile object-fixed coordinate system is defined as n, and the unit vector in the directional direction of the antenna 10 in the gimbal coordinate system is defined as n'.

In order to derive an equation for computing the axial discrepancy amount $\phi$ of plural sets of $(\Psi, \Psi')$ stored in the axial-discrepancy amount calculating section 21, several basic equations are derived in the following.

The antenna is fitted to the mobile object so that the axial discrepancy between the mobile object-fixed coordinate system and the gimbal coordinate system becomes infinitesimal, and also it can be predicted that the axial discrepancy due to the deformation of the airframe after the antenna installation is infinitesimal. Therefore, it may be assumed that the axial discrepancy amount $\phi$ is infinitesimal. Under this assumption, the coordinate transformation matrix $W(\phi)$ can be approximated as follows.

$$W(\varphi)=\begin{pmatrix} 1 & \varphi_3 & -\varphi_2 \\ -\varphi_3 & 1 & \varphi_1 \\ \varphi_2 & -\varphi_1 & 1 \end{pmatrix} \tag{1}$$

By using the azimuth angle and the elevation angle $\Psi$ of the satellite in the mobile object-fixed coordinate system computed by the satellite direction computing section 19, the unit vector n in the satellite direction in the mobile object-fixed coordinate system will be given as follows.

$$n=\begin{pmatrix} \cos\theta\cos\psi \\ \cos\theta\sin\psi \\ \sin\theta \end{pmatrix} \tag{2}$$

By using the azimuth angle and the elevation angle $\Psi'$ of the antenna 10 in the gimbal coordinate system output from the angle sensor 13, the unit vector n' in the directional direction of the antenna 10 in the gimbal coordinate system will be given as follows.

$$n'=\begin{pmatrix} \cos\theta'\cos\psi' \\ \cos\theta'\sin\psi' \\ \sin\theta' \end{pmatrix} \tag{3}$$

Assuming that the difference $\delta\Psi$ is also infinitesimal since the axial discrepancy amount $\phi$ is infinitesimal, Eq. (3) may be written by using $\Psi$ and $\delta\Psi$ as follows.

$$n'=n+H(\Psi)\delta\Psi \tag{4}$$

$$H(\Psi)=\begin{pmatrix} -\cos\theta\sin\psi & -\sin\theta\cos\psi \\ \cos\theta\cos\psi & -\sin\theta\sin\psi \\ 0 & \cos\theta \end{pmatrix} \tag{5}$$

If the coordinate transformation matrix and Eq. (1) are employed, the relationship between the unit vectors n and n' can be represented as follows.

$$n'=W(\phi)n \tag{6}$$

The relationship between $\delta\Psi$ and $\phi$ can be derived from Eq. (4) and Eq. (6) as follows.

$$H(\Psi)\delta\Psi=[W(\phi)-I]\cdot n \tag{7}$$

In Eq. (7), I is a unit matrix. In order to represent unknown $\phi$ positively, a following equation can be derived by rewriting the right side of Eq. (7).

$$H(\Psi)\delta\Psi=W'(\Psi)\phi \tag{8}$$

$$W'(\Psi)=\begin{pmatrix} 0 & -\sin\theta & \cos\theta\sin\psi \\ \sin\theta & 0 & -\cos\theta\cos\psi \\ -\cos\theta\sin\varphi & \cos\theta\cos\psi & 0 \end{pmatrix} \tag{9}$$

In addition, following observation equations of the axial discrepancy amount $\phi$ can be obtained by applying an appropriate matrix operation to Eq. (8).

$$\delta\Psi=C(\Psi)\phi \tag{10}$$

$$C(\Psi)=(H^TH)^{-1}H^TW'=\begin{pmatrix} \tan\theta\cos\psi & \tan\theta\sin\psi & -1 \\ -\sin\psi & \cos\psi & 0 \end{pmatrix} \tag{11}$$

If a plurality of sets of $(\Psi, \Psi')$ are obtained, if these data sets are represented as $(\Psi, \Psi'_i)$ (i=1,2, . . . ,n), by assuming the difference $\Psi_i-\Psi'_i$ as $\delta\Psi_I$, the least square estimate value of the axial discrepancy amount $\phi$ can be represented by a following equation (12).

$$\varphi=\left[\sum_i C(\Psi_i)^T W_i C(\Psi_i)\right]^{-1}\left[\sum_i C(\Psi_i)^T W_i \delta\Psi_i\right] \tag{12}$$

Where $W_i$ (i=1,2, . . . ,n) is a predetermined three-row/three-column weight. In the axial-discrepancy amount calculating section 21, first the differences $\delta\Psi_i=\Psi_i'-\Psi_i$ of the plurality of sets of accumulated values $(\Psi_I, \Psi_I')$ are calculated, and then the least square estimate value of the axial discrepancy amount $\phi$ is computed according to Eq. (12) using the difference values and the values $(\Psi_I, \Psi_I')$. This least square estimate value of the axial discrepancy amount $\phi$ is output to the axial-discrepancy amount correcting section 20.

If an error covariance matrix R of the measured error of the amount $\delta\Psi$ calculated by the axial-discrepancy amount calculating section 21 has already been known, the maximum likelihood estimate value of the axial discrepancy amount $\phi$ can be obtained as follows.

$$\varphi = \left[\sum_i C(\Psi_i)^T R^{-1} C(\Psi_i)\right]^{-1} \left[\sum_i C(\Psi_i)^T R^{-1} \delta\Psi_i\right] \tag{13}$$

In addition, the estimated error covariance matrix P of the axial discrepancy amount $\phi$ can be obtained as follows.

$$P = \left[\sum_i C(\Psi_i)^T R^{-1} C(\Psi_i)\right]^{-1} \tag{14}$$

It is possible to compute the variance value of the estimation error of the axial discrepancy amount $\phi$ estimated by the estimated error covariance matrix P in Eq. (14). As a result, if the error covariance matrix R of the measured error of the amount $\delta\Psi$ calculated by the axial-discrepancy amount calculating section 21 has already been known, functions of the axial-discrepancy amount calculating section 21 can be set as follows as another embodiment of the embodiment 1. That is, when the control signal indicating that the directional direction of the antenna 10 is converged is being output from the peak direction estimating section 14, the axial-discrepancy amount calculating section 21 stores the azimuth angle and the elevation angle of the antenna 10 in the gimbal coordinate system output from the angle sensor 13 and the azimuth angle and the elevation angle in the satellite direction output in the mobile object-fixed coordinate system from the satellite direction computing section 19 into the memory device provided in the axial-discrepancy amount calculating section 21, computes the variance value of the estimated error of the axial discrepancy amount $\phi$ based on the stored data every time when the data are stored, computes the axial discrepancy amount between the mobile object-fixed coordinate system and the gimbal coordinate system of the antenna 10 based on the accumulated data at a point of time when the computed variance value of the estimated error is less than a predetermined value, changes the axial discrepancy amount stored in the axial-discrepancy amount correcting portion 20, and executes the initialization of the above memory device and the initialization of the correction amount in the peak direction estimating section 14.

Embodiment 2

Figure 2:
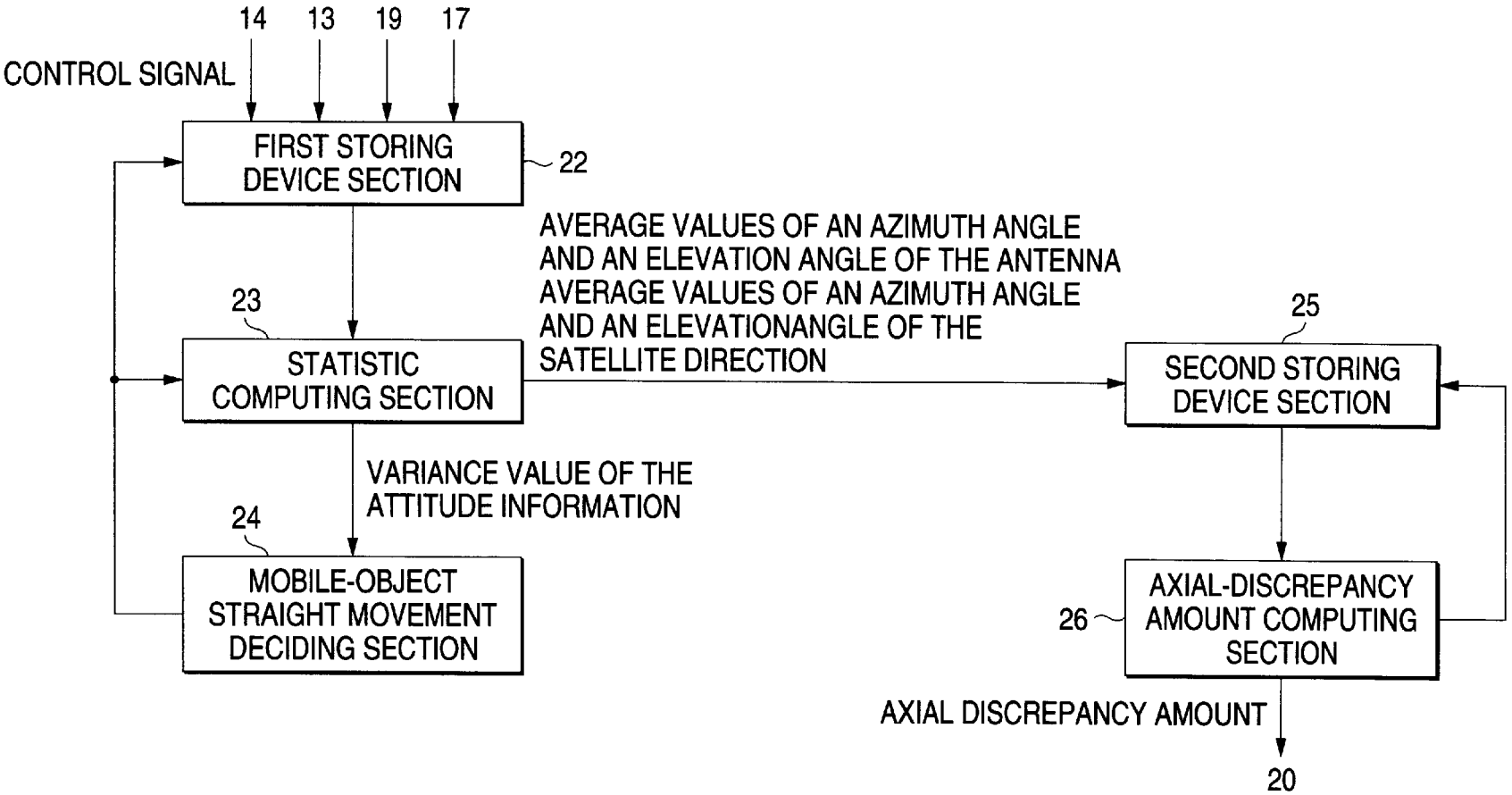
FIG. 2 is a block diagram showing a configuration of an axial-discrepancy amount calculating section of the satellite-tracking antenna controlling apparatus according to an embodiment 2 of the present invention.
Figure 3:
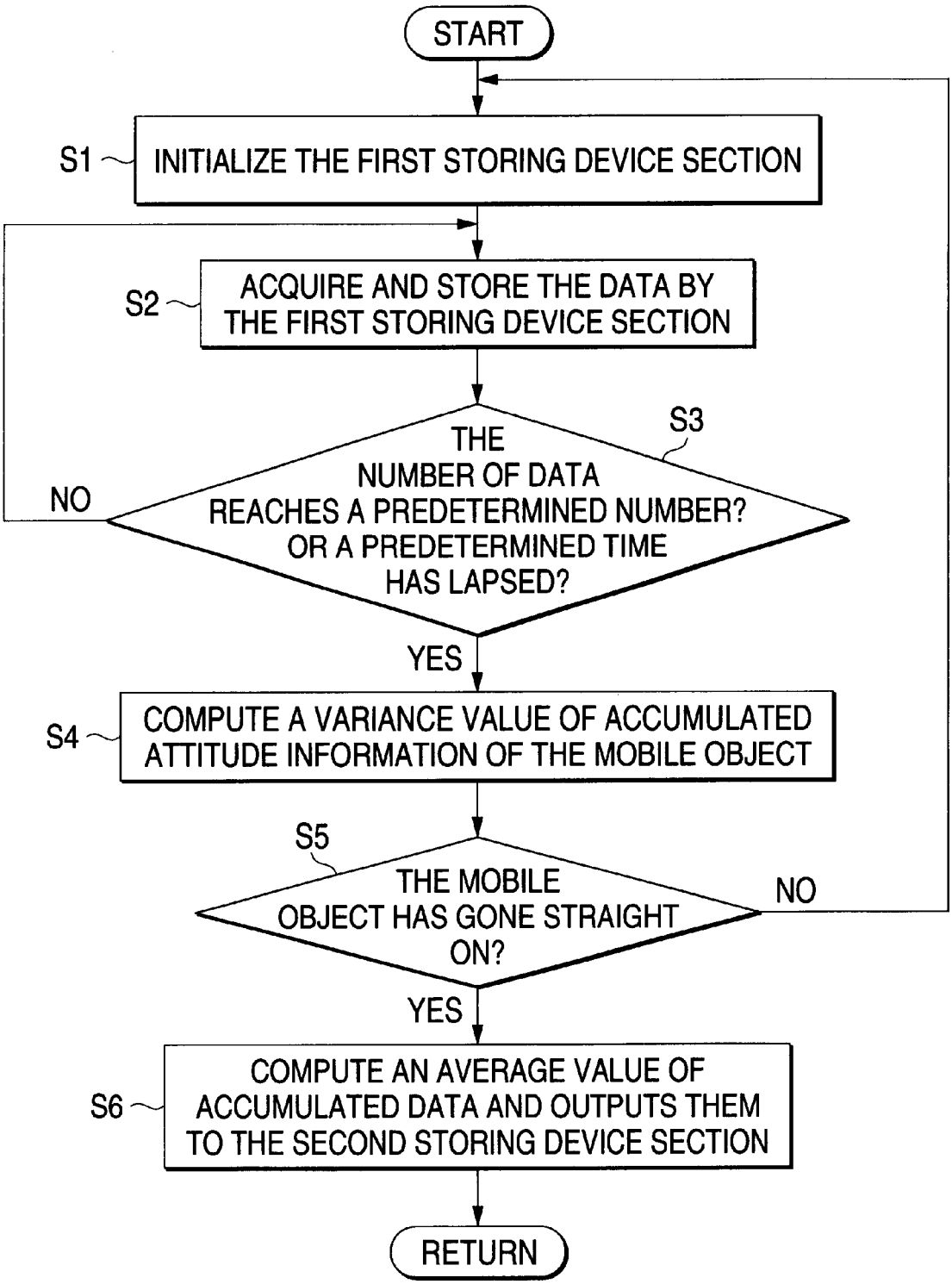
FIG. 3 is a flowchart showing flow of data storing process involving decision of a mobile-object straight movement in the axial-discrepancy amount calculating section of the satellite-tracking antenna controlling apparatus according to the embodiment 2 of the present invention.
Figure 4:
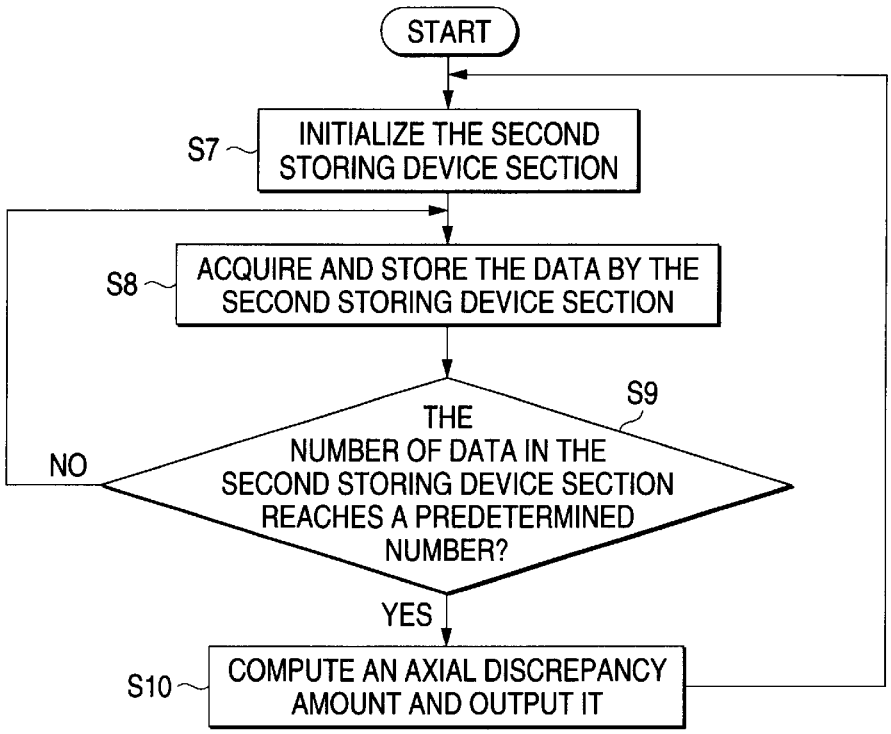
FIG. 4 is a flowchart showing flow of a computing process of an axial discrepancy amount in the axial-discrepancy amount calculating section of the satellite-tracking antenna controlling apparatus according to the embodiment 2 of the present invention.

A satellite-tracking antenna controlling apparatus according to an embodiment 2 of the present invention will be explained with reference to FIG. 2 to FIG. 4 hereunder. FIG. 2 is a block diagram showing a configuration of an axial-discrepancy amount calculating section of the satellite-tracking antenna controlling apparatus according to the embodiment 2 of the present invention. FIG. 3 is a flowchart showing flow of data storing process involving decision of a mobile-object straight movement in the axial-discrepancy amount calculating section of the satellite-tracking antenna controlling apparatus according to the embodiment 2 of the present invention. FIG. 4 is a flowchart showing flow of calculation process of an axial discrepancy amount in the axial-discrepancy amount calculating section of the satellite-tracking antenna controlling apparatus according to the embodiment 2 of the present invention. In FIG. 2, reference numeral 22 denotes a first storing device section for storing the azimuth angle and the elevation angle of the antenna 10 in the gimbal coordinate system output from the angle sensor 13, the azimuth angle and the elevation angle of the satellite direction in the mobile object-fixed coordinate system output from the satellite direction computing section 19, and the mobile-object attitude information output from the inertial navigation unit 17. The storing process in the first storing device section 22 is carried out when the control signal indicating that the directional direction of the antenna 10 is converged is being output from the peak direction estimating section 14. Reference numeral 23 denotes a statistic computing section for calculating each of average values of the azimuth angle and the elevation angle of the antenna 10 in the gimbal coordinate system stored in the first storing device section 22, each of average values of the azimuth angle and the elevation angle in the satellite direction in the mobile object-fixed coordinate system output from the satellite direction computing section 19, and the variance value of the attitude information of the mobile object output from the inertial navigation unit 17, reference numeral 24 denotes a mobile-object straight movement deciding section for deciding whether or not the mobile object goes straight during the first storing device section 22 stores each data, based on the variance value of the attitude information of the mobile object output from the statistic computing section 23, reference numeral 25 denotes a second storing device section for storing each of average values of the azimuth angle and the elevation angle of the antenna 10 in the gimbal coordinate system output from the statistic computing section 23 and each of average values of the azimuth angle and the elevation angle in the satellite direction in the mobile object-fixed coordinate system output from the satellite direction computing section 19, and reference numeral 26 denotes an axial-discrepancy amount computing section for computing the axial discrepancy amount based on each of average values of the azimuth angle and the elevation angle of the antenna 10 in the gimbal coordinate system stored in the second storing device section and each of average values of the azimuth angle and the elevation angle in the satellite direction in the mobile object-fixed coordinate system output from the satellite direction computing section 19. Incidentally, in the satellite-tracking antenna controlling apparatus according to the embodiment 2, the axial-discrepancy amount calculating section 21 in the satellite-tracking antenna controlling apparatus shown in FIG. 1 is constructed as shown in FIG. 2.

Next, an operation of the axial-discrepancy amount calculating section 21 in the satellite-tracking antenna controlling apparatus according to the embodiment 2 will be explained with reference to flowcharts in FIG. 3 and FIG. 4 hereunder. First, in step S1 in FIG. 3, the first storing device section 22 is initialized. Then, in step S2, when the control signal indicating that the directional direction of the antenna is converged is being output from the peak direction estimating section 14, the first storing device section 22 acquires the azimuth angle and the elevation angle of the antenna 10 in the gimbal coordinate system output from the angle sensor 13, the azimuth angle and the elevation angle in the satellite direction in the mobile object-fixed coordinate system output from the satellite direction computing section 19, and the attitude information of the mobile object output from the inertial navigation unit 17, and then stores such data therein. Then, in step S3, it is decided whether or not the number of data has reached a predetermined number or a predetermined time has lapsed from the start of data acquisition. If any one of the conditions is satisfied, the process goes to step S4. If none of the conditions is satisfied, the data acquisition in step S2 is repeated.

In step S4, the statistic computing section 23 computes the variance value of the attitude information of the mobile object output from the inertial navigation unit 17. In step S5, the mobile-object straight movement deciding section 24 compares the variance value of the attitude information of the mobile object output from the statistic computing section 23 with a predetermined value to decide whether or not the mobile object has gone straight on. In other words, if the variance value of the attitude information of the mobile object output from the statistic computing section 23 is smaller than the predetermined value, the mobile-object straight movement deciding section 24 decides that the mobile object has gone straight on. Then, the process goes to step S6. In step S6, the statistic computing section 23 computes each of average values of the azimuth angle and the elevation angle of the antenna 10 in the gimbal coordinate system output from the first storing device section 22 and also each of average values of the azimuth angle and the elevation angle in the satellite direction in the mobile object-fixed coordinate system output from the satellite direction computing section 19, and then outputs them to the second storing device section 25. Here, since all the data stored in the first storing device section 22 are used, the data in the first storing device section 22 are canceled and initialized after the data have been output from the first storing device section 22 to the statistic computing section 23. Also, in step S5, if the mobile-object straight movement deciding section 24 decides that the mobile object has not gone straight on, the process is returned to step S1 to acquire the data again. The reason for that the data acquisition is executed once again when the mobile object has not gone straight on is that since the satellite-tracking control is being carried out by the antenna 10 in a state that the attitude of the mobile object is not stabilized, an error between the directional direction of the antenna and the satellite direction in this tracking control operation should not be decided as the axial discrepancy amount.

Next, the process in the axial-discrepancy amount calculating section 21 will be explained with reference to a flow of axial discrepancy amount calculation in FIG. 4 hereunder. First, in step S7, the second storing device section 25 is initialized. Then, in step S8, the second storing device section 25 receives the output of the statistic computing section 23 obtained in step S6 in FIG. 3. That is, in step S8, the second storing device section 25 acquires each of average values of the azimuth angle and the elevation angle of the antenna 10 in the gimbal coordinate system output from the statistic computing section 23 and each of average values of the azimuth angle and the elevation angle in the satellite direction in the mobile object-fixed coordinate system output from the satellite direction computing section 19, and store them therein. Then, in step S9, it is decided whether or not the number of data in the second storing device section 25 reaches a predetermined number. If the number of data has reached the predetermined number, the process goes to step S10. Unless the number of data has reached the predetermined number, the data acquisition and storing in step S8 are repeated. In step S10, if the number of data about each of average values of the azimuth angle and the elevation angle of the antenna 10 in the gimbal coordinate system stored in the second storing device section 25 and each of average values of the azimuth angle and the elevation angle in the satellite direction in the mobile object-fixed coordinate system output from the satellite direction computing section 19 has reached the predetermined number, the axial-discrepancy amount computing section 26 computes the changed value of the axial discrepancy amount based on the equations described in the embodiment 1, and then outputs it to the axial-discrepancy amount correcting section 20.

Embodiment 3

Figure 5:
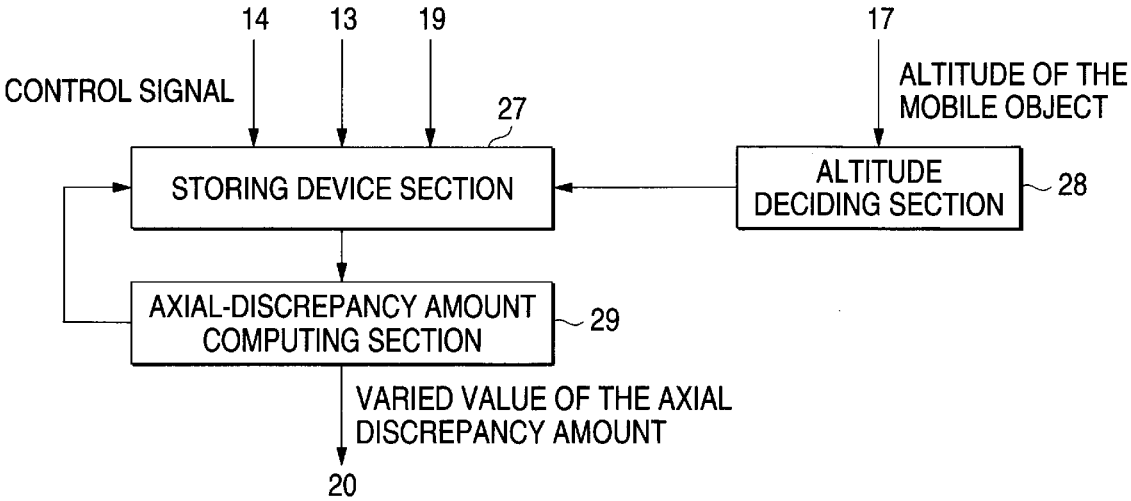
FIG. 5 is a block diagram showing a configuration of an axial-discrepancy amount calculating section of the satellite-tracking antenna controlling apparatus according to an embodiment 3 of the present invention.
Figure 6:
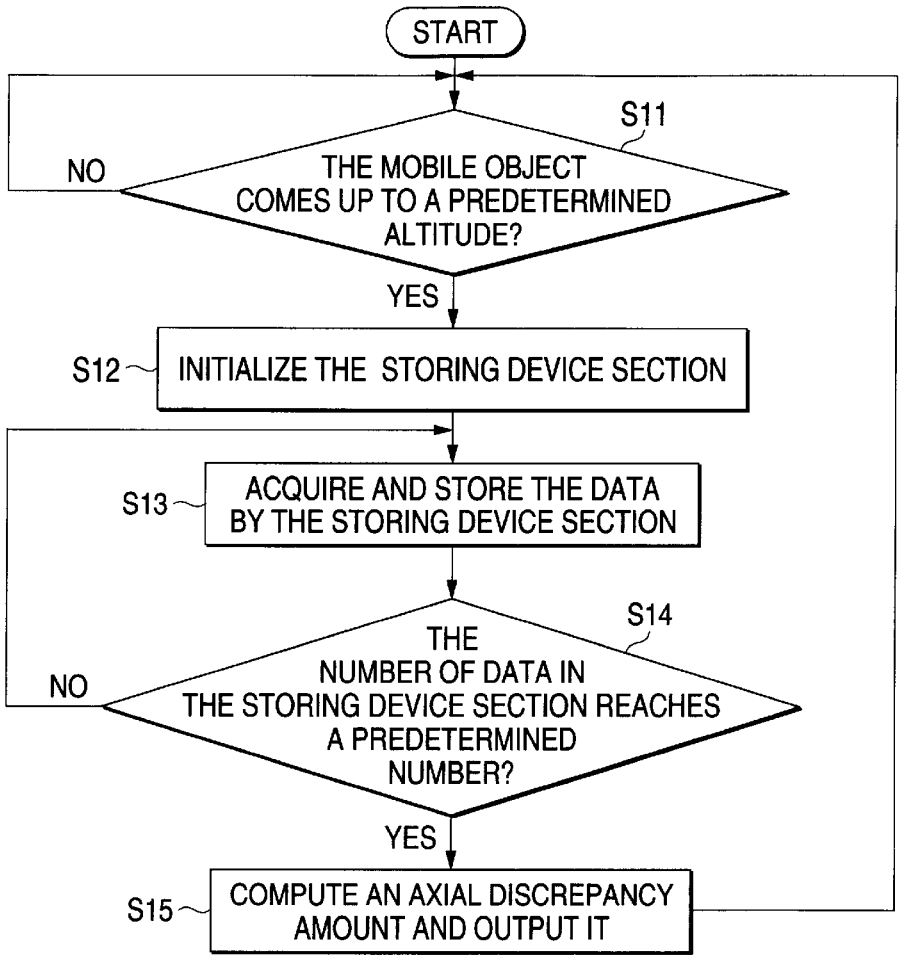
FIG. 6 is a flowchart showing flow of process in the axial-discrepancy amount calculating section of the satellite-tracking antenna controlling apparatus according to the embodiment 3 of the present invention.

A satellite-tracking antenna controlling apparatus according to an embodiment 3 of the present invention will be explained with reference to FIG. 5 and FIG. 6 hereunder. FIG. 5 is a block diagram showing a configuration of an axial-discrepancy amount calculating section of the satellite-tracking antenna controlling apparatus according to the embodiment 3 of the present invention. FIG. 6 is a flowchart showing flow of process in the axial-discrepancy amount calculating section of the satellite-tracking antenna controlling apparatus according to the embodiment 3 of the present invention. In FIG. 5, reference numeral 27 denotes a storing device section for acquiring and storing the azimuth angle and the elevation angle of the antenna 10 in the gimbal coordinate system output from the angle sensor 13 and the azimuth angle and the elevation angle in the satellite direction in the mobile object-fixed coordinate system output from the satellite direction computing section 19, when the control signal indicating that the directional direction of the antenna 10 is converged is output from the peak direction estimating section 14, reference numeral 28 denotes an altitude deciding section for outputting a control signal to command the storing device section 27 to start the data acquisition when the altitude of the mobile object output from the inertial navigation unit 17 reaches a predetermined value, and reference numeral 29 denotes an axial-discrepancy amount computing section for computing each of average values of the azimuth angle and the elevation angle of the antenna 10 in the gimbal coordinate system stored in the storing device section 27 and each of average values of the azimuth angle and the elevation angle in the satellite direction in the mobile object-fixed coordinate system output from the satellite direction computing section 19 and then computing the axial discrepancy amount based on these calculated average values. In this case, in the satellite-tracking antenna controlling apparatus according to the embodiment 3, the axial-discrepancy amount calculating section 21 in the satellite-tracking antenna controlling apparatus shown in FIG. 1 is constructed as shown in FIG. 3.

Next, an operation of the axial-discrepancy amount calculating section 21 in the satellite-tracking antenna controlling apparatus according to the embodiment 3 will be explained with reference to a flowchart in FIG. 6 hereunder. In step S11, the altitude deciding section 28 decides whether or not the altitude of the mobile object has reached the predetermined altitude when the axial-discrepancy amount calculating function is started. Unless the altitude of the mobile object has reached the predetermined altitude, the process is returned to the preceding state of this decision. If it is decided that the mobile object has come up to the predetermined altitude, the process goes to step S12 to initialize the storing device section 27. Then, the process goes to step S13 in which the storing device section 27 acquires respective data. When the control signal indicating that the directional direction of the antenna is converged is output from the peak direction estimating section 14, the storing device section 27 acquires the azimuth angle and the elevation angle of the antenna 10 in the gimbal coordinate system output from the angle sensor 13 and the azimuth angle and the elevation angle in the satellite direction in the mobile object-fixed coordinate system output from the satellite direction computing section 19, and then stores them therein. Then, the process goes to step S14 to decide whether or not the number of data stored in the storing device section 27 has reached a predetermined number. Unless the number of data has reached the predetermined number, the process is returned to step S13 to execute the data acquisition. If the number of data stored in the storing device section 27 has reached the predetermined number, the process goes to step S15. Here the axial discrepancy amount is computed by using all the data stored in the storing device section 27 and is outputted to the axial-discrepancy amount correcting section 20. Then, the process is returned to step S11 to decide the altitude of the mobile object.

The embodiment 3 can correct sequentially the axial discrepancy between the mobile object-fixed coordinate system and the gimbal coordinate system caused by the deformation of the airframe which is due to the temperature change generated by the change in the altitude of the mobile object and/or the difference in atmospheric pressures between the inside and the outside of the airframe of the mobile object. In particular, in the mobile object such as the airplane which is subjected to severe change of the altitude, the satellite tracking control can be achieved with high precision by correcting the axial discrepancy amount during the navigation.

Embodiment 4

Figure 7:
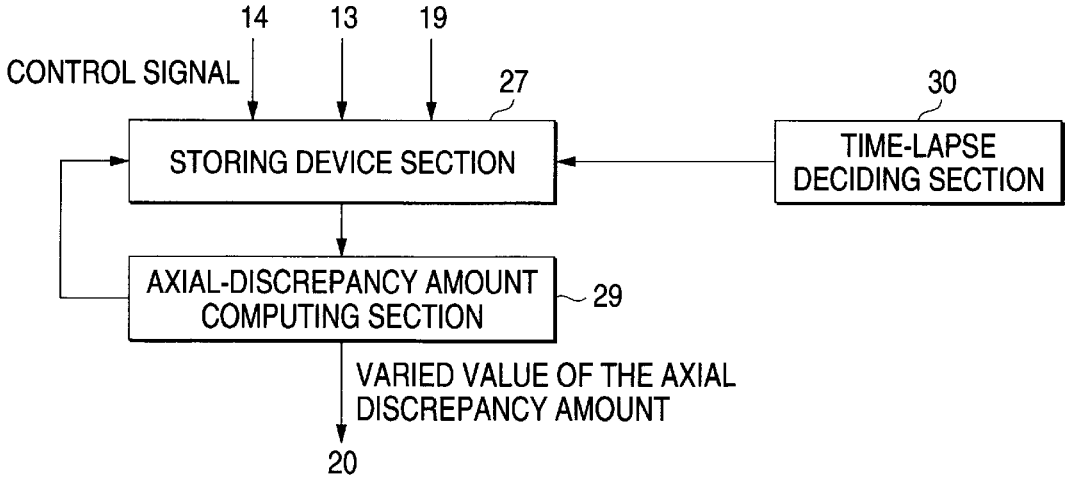
FIG. 7 is a block diagram showing a configuration of an axial-discrepancy amount calculating section of the satellite-tracking antenna controlling apparatus according to an embodiment 4 of the present invention.

A satellite-tracking antenna controlling apparatus according to an embodiment 4 of the present invention will be explained with reference to FIG. 7 hereunder. FIG. 7 is a block diagram showing a configuration of an axial-discrepancy amount calculating section of the satellite-tracking antenna controlling apparatus according to the embodiment 4 of the present invention. In FIG. 7, reference numeral 30 denotes a time-lapse deciding section for deciding whether or not a predetermined time has lapsed from a point of time when the power supply of the mobile object is turned ON or a time origin such as a start time of the mobile object. In FIG. 7, the same references as those in FIG. 5 denote the same or equivalent circuits as or to those in FIG. 5. In the axial-discrepancy amount calculating section 21 shown in FIG. 7, the altitude deciding section 28 in the axial-discrepancy amount calculating section 21 explained in the embodiment 3 in FIG. 5 is replaced with the time-lapse deciding section 30 to eliminate the input to the altitude deciding section 28 from the inertial navigation unit 17. In this case, in the satellite-tracking antenna controlling apparatus according to the embodiment 4, the axial-discrepancy amount calculating section 21 in the satellite-tracking antenna controlling apparatus shown in FIG. 1 is constructed as shown in FIG. 7.

When the predetermined time has lapsed from the point of time when the power supply of the mobile object is turned ON or the time origin such as the start time of the mobile object, the time-lapse deciding section 30 outputs the control signal to command the storing device section to start the data acquisition. Then, the processes executed in the storing device section 27 and the axial-discrepancy amount computing section 29 are similar to the processes explained with reference to FIG. 5 and FIG. 6 in the embodiment 3. Since the corrected value of the axial discrepancy amount in the axial-discrepancy amount correcting section 20 can be varied by computing the axial discrepancy amount based on the predetermined time-lapse from the point of time when the power supply of the mobile object is turned ON or the time origin such as the start time of the mobile object, the maintainability of the satellite-tracking antenna controlling apparatus can be improved.

Embodiment 5

Figure 8:
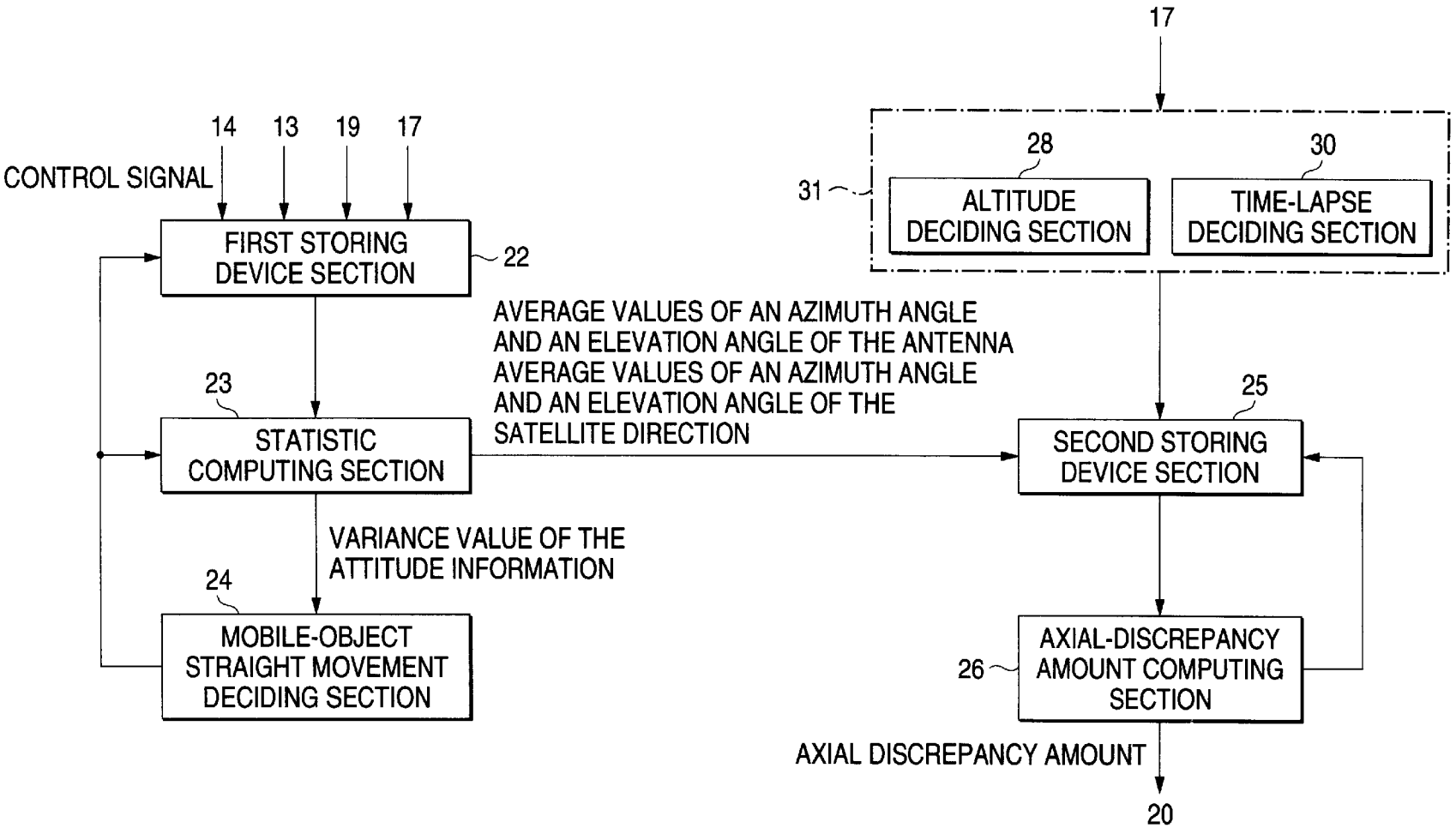
FIG. 8 is a block diagram showing a configuration of an axial-discrepancy amount calculating section of the satellite-tracking antenna controlling apparatus according to an embodiment 5 of the present invention.
Figure 9:
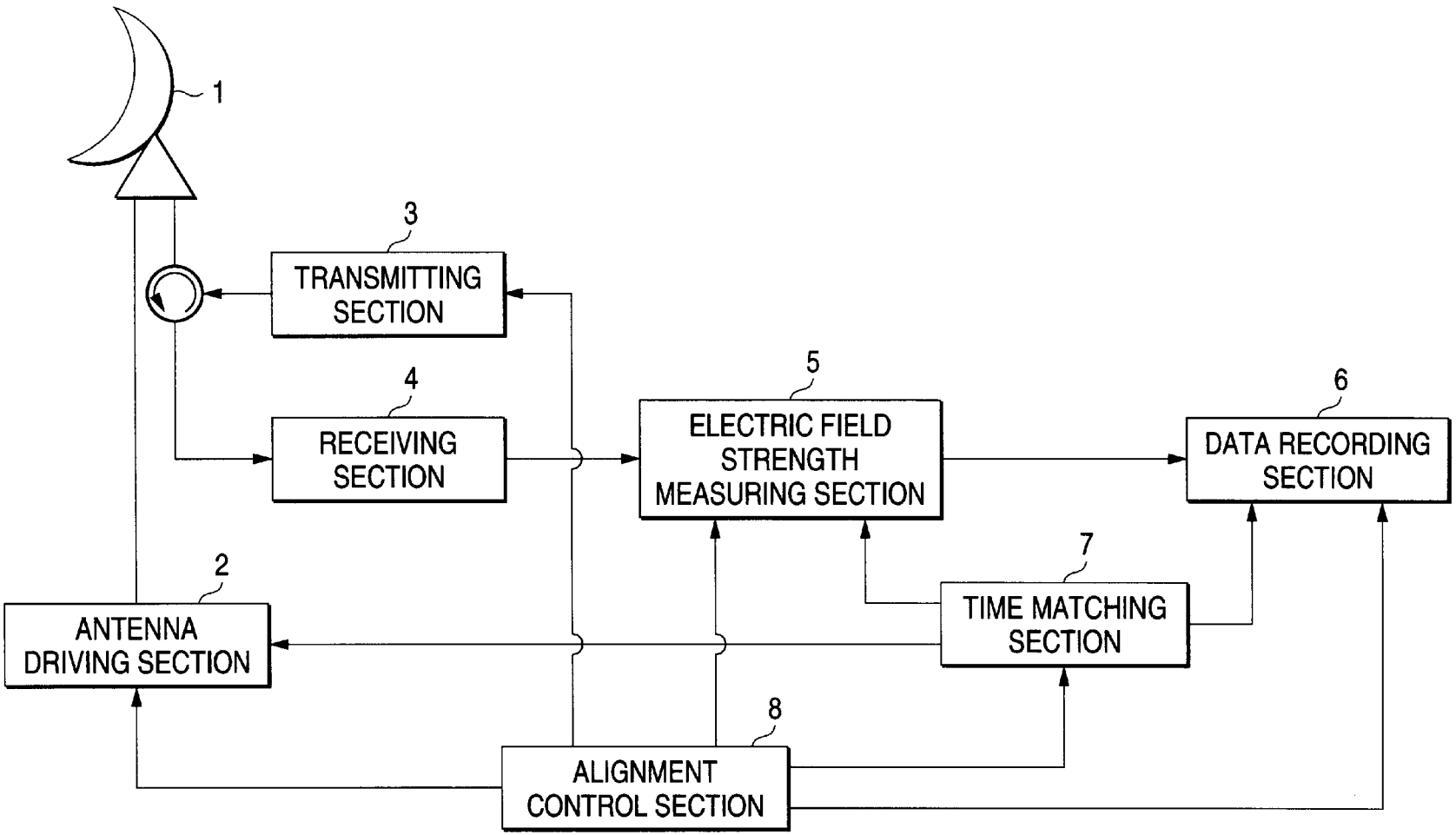
FIG. 9 is a block diagram showing an antenna apparatus according to the related art.

A satellite-tracking antenna controlling apparatus according to an embodiment 5 of the present invention will be explained with reference to FIG. 8 hereunder. FIG. 8 is a block diagram showing a configuration of an axial-discrepancy amount calculating section of the satellite-tracking antenna controlling apparatus according to the embodiment 5 of the present invention. In FIG. 8, reference numeral 31 denotes an axial-discrepancy amount acquiring condition deciding section for deciding the altitude of the mobile body by the altitude deciding section 28 or deciding the time-lapse by the time-lapse deciding section 30. In FIG. 8, the same references as those in FIG. 2 denote the same or equivalent circuits as or to those in FIG. 2. Also, the altitude deciding section 28 and the time-lapse deciding section 30 in FIG. 8 correspond to the same or equivalent circuits as or to those to which the same references are allotted in FIG. 5 and FIG. 7.

In the axial-discrepancy amount calculating section 21 of the satellite-tracking antenna controlling apparatus according to the embodiment 5, as the conditions under which the second storing device section 25 executes the data acquisition and storing in step S8 in FIG. 4, the altitude decision made by the altitude deciding section 28 or the time-lapse decision made by the time-lapse deciding section 30 is added to the axial-discrepancy amount calculating section 21 explained in FIG. 2 and the embodiment 2 that corresponds to FIG. 2. In other words, the second storing device section 25 starts the data acquisition and storing based on the altitude decision made by the altitude deciding section 28 or the time-lapse decision made by the time-lapse deciding section 30, and then the axial-discrepancy amount computing section 26 computes the axial discrepancy amount when the number of data has reached the predetermined number. Since the axial discrepancy amount of the satellite-tracking antenna controlling apparatus can be computed and changed by the axial-discrepancy amount calculating section constructed in this manner, the high precision satellite-tracking control and the maintenance of the controlling section can be achieved so as to respond to complicated application modes of the mobile object.

According to a first aspect of the invention, the axial discrepancy amount between the gimbal coordinate system and the mobile object-fixed coordinate system can be computed and changed based on the azimuth angle and the elevation angle of the antenna driven to the direction at which the received signal level becomes peak in the gimbal coordinate system and the azimuth angle and the elevation angle of the satellite direction computed based on the position and attitude information from the inertial navigation unit in the mobile object-fixed coordinate system. Therefore, the tracking control of the antenna toward the satellite direction can be attained with high precision.

According to a second aspect of the invention, the axial discrepancy amount is computed and changed under the condition that the mobile object is going straight on. Therefore, the mixing of the error generated in the satellite tracking control by the antenna between the directional direction of the antenna and the satellite direction as the axial discrepancy amount can be suppressed.

According to a third aspect of the invention, the axial discrepancy amount is computed and changed under the condition that the mobile object has reached the predetermined altitude. Therefore, the axial discrepancy caused by the deformation of the airframe that is due to the change in altitude of the mobile object between the mobile object-fixed coordinate system and the gimbal coordinate system can be corrected.

According to a fourth aspect of the invention, the axial discrepancy amount is computed and changed based on the predetermined time-lapse from the point of time when the power supply of the mobile object is turned ON or the time origin such as the start time of the mobile object. Therefore, the maintainability of the satellite-tracking antenna controlling apparatus can be improved.

What is claimed is:

1. A satellite-tracking antenna controlling apparatus comprising:

a satellite direction computing section for computing an azimuth angle and an elevation angle of a satellite in a mobile object-fixed coordinate system fixed to a mobile object based on position information and attitude information of the mobile object, that are output from an inertial navigation unit provided to the mobile object and position information of the satellite as a tracking object;

an axial-discrepancy amount correcting section for correcting the azimuth angle and the elevation angle of the satellite computed in the satellite direction computing section based on an axial discrepancy amount between the mobile object-fixed coordinate system and a gimbal coordinate system of the antenna that is installed in the mobile object to output the corrected azimuth angle and the corrected elevation angle as a drive command signal;

a receiver for receiving a signal transmitted from the satellite via the antenna that is driven by the drive command signal;

a peak direction drive controlling section for driving the antenna toward a direction in which a level of a received signal received by the receiver becomes peak;

an angle sensor for detecting an azimuth angle and an elevation angle of the antenna driven by the peak direction drive controlling section in the gimbal coordinate system; and an axial-discrepancy amount calculating section for computing discrepancy amounts between the azimuth angle and the elevation angle of the antenna in the gimbal coordinate system detected by the angle sensor and the azimuth angle and the elevation angle of the satellite computed by the satellite direction computing section to command the axial-discrepancy amount correcting section to change the axial discrepancy amount.

2. The satellite-tracking antenna controlling apparatus according to claim 1, wherein the axial-discrepancy amount calculating section commands the axial-discrepancy amount correcting section to change the axial discrepancy amount when the axial-discrepancy amount calculating section decides that the mobile object is going straight on based on the attitude information of the mobile object output from the inertial navigation unit.

3. The satellite-tracking antenna controlling apparatus according to claim 1, wherein the axial-discrepancy amount calculating section commands the axial-discrepancy amount correcting section to change the axial discrepancy amount when the axial-discrepancy amount calculating section decides that the mobile object has reached a predetermined altitude based on altitude information of the mobile object output from the inertial navigation unit.

4. The satellite-tracking antenna controlling apparatus according to claim 1, wherein the axial-discrepancy amount calculating section commands the axial-discrepancy amount correcting section to change the axial discrepancy amount when the axial-discrepancy amount calculating section decides that a predetermined time has lapsed from a start time of the mobile object.

* * * * *